United States Patent [19]

Zwier

[11] Patent Number: 4,890,031

[45] Date of Patent: Dec. 26, 1989

[54] SEMICONDUCTOR CATHODE WITH INCREASED STABILITY

[75] Inventor: Jan Zwier, Eindhoven, Netherlands

[73] Assignee: U.S. Philips Corp., New York, N.Y.

[21] Appl. No.: 298,819

[22] Filed: Jan. 18, 1989

Related U.S. Application Data

[63] Continuation of Ser. No. 147,029, Jan. 19, 1988, abandoned, which is a continuation of Ser. No. 793,886, Nov. 1, 1985, abandoned.

[30] Foreign Application Priority Data

Nov. 21, 1984 [NL] Netherlands ..... 8403538
May 24, 1985 [NL] Netherlands ..... 8501490

[51] Int. Cl.[4] ..... H01J 29/04

[52] U.S. Cl. ..... 313/409; 313/444; 313/446

[58] Field of Search ..... 313/409, 390, 424, 446, 313/366, 444

[56] References Cited

U.S. PATENT DOCUMENTS 4,325,084 4/1982 van Gorkom et al. ..... 313/446 X
4,370,797 2/1983 van Gorkom et al. ..... 313/303 X
4,574,216 3/1986 Hoeberechts et al. ..... 313/390 X

FOREIGN PATENT DOCUMENTS 1198567 5/1966 United Kingdom ..... 313/409
2117173 3/1982 United Kingdom ..... 313/446

*Primary Examiner*—Kenneth Wieder
*Attorney, Agent, or Firm*—Steven R. Biren

[57] ABSTRACT

The stability of semiconductor cathodes is improved by reducing the effective emitting surface area. This is effected by producing emission patterns by means of separate emission regions, whose overall surface area is much smaller than that of the actual emission patter. Due to the higher emission current and adjustment current, adsorbed particles, which adversely affect the stability of the emission, are rapidly drained.

14 Claims, 5 Drawing Sheets

SEMICONDUCTOR CATHODE WITH INCREASED STABILITY

This is a continuation of application Ser. No. 147,029, filed Jan. 19, 1988, now abandoned, which is a continuation of application Ser. No. 793,886, filed Nov. 1, 1985, now abandoned.

BACKGROUND OF THE INVENTION

The invention relates to a semiconductor device for producing an electron current comprising a cathode having a semiconductor body provided at a major surface with at least one group of regions which in the operating condition can be given substantially the same operational adjustment on behalf of the emission of electrons.

The invention further relates to a display and a pick-up device provided with such a semiconductor device.

Such arrangements are known from the Netherlands Patent Application No. 7905470 laid open to public inspection on Jan. 15 1981.

In this Application, inter alia a flat display arrangement is shown provided with a fluorescent screen which is activated by electrons originating from a semiconductor device having emission regions which are organized in an xy matrix and in which, depending upon the drive of different groups of emission regions, alternating patterns of electron emission and hence different fluorescent patterns are generated.

In the example concerned, use is made of semiconductor cathodes whose operation is based on avalanche multiplication of electrons when a pn junction is reversebiased. The pn junction has at the area of the emitting surface a reduced breakdown voltage and is separated in situ from the surface by an n-type conducting layer having such a thickness and doping that at the breakdown voltage the depletion zone does not extend as far as the surface, but remains separated therefrom by a surface layer which is sufficiently thin to pass the generated electrons.

The said Patent Application also discloses an application in which such a semiconductor cathode is used in an electron tube, in which the emitting surface is substantially annular. With the use of such a semiconductor cathode in conventional cathode-ray tubes, there is generally not, as in the embodiment shown therein, a virtual source, but the electrons emitted by the semiconductor cathode meet in a so-called "cross-over". The electrons then move mainly along the surface of the generated beam, which, as described in the said Patent Application, may be advantageous from an electro-optical point of view.

In general the desired electron current is fixed, depending upon the type of cathode-ray tube in which the semiconductor cathode is used. Electrode currents (beam currents) higher than 100 $\mu$A may be produced, for example, by means of semiconductor cathodes having an annular emitting surface having a diameter exceeding approximately 20 $\mu$m. Due to this electron current in connection with the overall emitting surface and the efficiency of the semiconductor cathode, the electron current density is then fixed.

This electron current density can then become so low that in practice stability problems occur. Any residual gases from the vacuum system (for example $H_2O$, $CO_2$, $O_2$) are adsorbed at the electronemitting surface and can interact in situ with a mono-atomic layer of caesium, which is generally applied in this surface to reduce the work function of the electrons generated in the semiconductor body, and with the surface of the semiconductor crystal. Under the influence of the electrons emanating from the semiconductor body, compounds then formed can be decomposed and adsorbed atoms are drained (desorption). Adsorbed atoms are also drained by diffusion from the emission region under the influence of electric fields (for example the fields produced by the adjustment current). In order to ensure that these mechanisms have sufficient influence, it is often required, however, to increase the electron current density by adjusting the adjustment current to a higher value than is practically possible or desirable.

SUMMARY OF THE INVENTION

The present invention has for its object to provide an arrangement of the kind mentioned above which has an increased stability.

An arrangement according to the invention is characterized for this purpose in that the group of regions has for the common operational adjustment electrical connections common to at least two corresponding elements of the regions.

The invention is based on the recognition of the fact that the stability of a semiconductor cathode is increased by means of the measure according to the invention in that a group of small emission regions can be homogeneously distributed over the surface defining the original emission pattern, the overall surface area of the emission regions being considerably smaller than that of the original pattern. In principle this already applies to very small emission patterns having a surface area of approximately 1 $\mu m^2$ and also to annular patterns having a diameter from approximately 10 $\mu$m with a ring width of approximately 0.5 $\mu$m.

The term "common electrical connections" is to be understood herein to mean that such measures are taken that the adjustment is practically equal for all regions belonging to one group, for example, by the use of common metallizations for corresponding semiconductor zones or highly doped buried semiconductor zones, which interconnect all semiconductor zones of the same type belonging to one group. If use is made of the type of semiconductor cathode described in Netherlands Patent Application No. 7905470, in which, for example, the group of electron-emitting regions is annular or is homogeneously distributed over an annular region, all p-type regions of the pn junctions are then interconnected to an electrically conducting manner via the metallization on the lower side of the semiconductor body, while the n-type regions are interconnected via deep n-diffusions outside the actual emitting surfaces. However, the accleration electrode shown therein may in turn be subdivided into several parts, which can be brought to separate potentials. However, this electrode may alternatively be omitted entirely or in part.

A preferred embodiment of an arrangement according to the invention is characterized in that the group of regions is arranged according to an annular pattern. Such an embodiment is particularly suitable, as stated above, for electron-optical considerations. Other arrangements of the emitting regions are also possible, for example, linear arrangements for display apparatus or the activation of laser material, as described in Netherlands Patent Application No. 8300631 and No. 8400632

Due to the said measure, a high local current density is obtained, which leads in principle to the desired stability of the cathode. Nevertheless it is desirable especially for the said cathodes with a reverse-biased pn junction that the effective current density is also as high as possible. This means inter alia that the so-called filling factor (quotient of the sum of the surface areas of the emitting regions and the whole surface area) has to be as high as possible.

In this type of cathode, however, an increasing filling factor gives rise to current supply problems due to the series resistance in the n-type region adjoining the major surface. This in turn leads, with high currents due to potential differences, to inequality of the adjustment of the pn junctions in the various electron-emitting regions. Moreover, due to the resistance in the n-type region, the cathode in practice conveys a comparatively low diode current (about 10 to 20% of the maximum permissible current as determined by the construction of the cathode, especially by the series resistance of the p-type region).

Additionally, any high current densities in the n-type surface regions may give rise to high electric fields, which may lead to caesium migration, as a result of which instability and inhomigeneity of the emission may occur.

A particular embodiment of a semiconductor device according to the invention, in which these problems are solved at least for the major part, is characterized in that the semiconductor body has a pn junction between an n-type region adjoining the major surface and a p-type region, . When a voltage is applied in the reverse direction across the pn junction, electrons are generated in the semiconductor body by avalanche multiplication, which electrons emanate from the semi-conductor body, the pn junction extending at least at the area of the electron-emitting regions mainly parallel to the major surface and having locally a lower breakdown voltage than the remaining part of the pn junction, the part having a lower breakdown voltage being separated from the surface by an n-type conducting layer having such a thickness and doping that at the breakdown voltage the depletion zone of the pn junction does not extend as far as the surface, but remains separated therefrom by a surface layer which is sufficiently thin to allow the generated electrons to pass, and the n-type region is coated with a layer of electrically conducting material, which contacts the n-type region and is provided with openings at the area of the electron-emitting regions.

Thus, a low-resistance current path parallel to the n-type region is obtained so that such a cathode can be operated at a high effective current density while avoiding the aforementioned problems.

A preferred embodiment of such a semiconductor device, by which a high filling factor can be attained, is characterized in that the electron-emitting regions are substantially strip-shaped.

BRIEF DESCRIPTION OF THE DRAWING

The invention will now be described more fully with reference to several embodiments and the drawing, in which:

FIG. 11 shows a display device manufactured with a semiconductor device according to the invention; while

Figure 1:
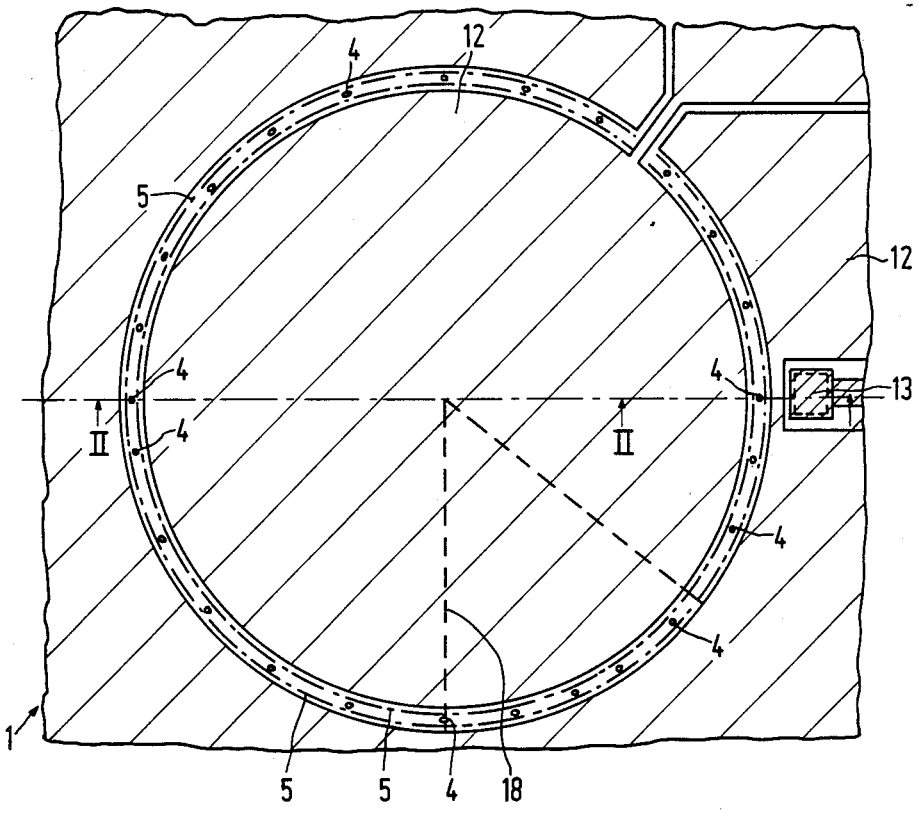
FIG. 1 is a plan view of a semiconductor device according to the invention.

The Figures are not drawn to scale, while for the sake of clarity, in the cross-sections more particularly the dimensions in the direction of thickness are greatly exaggerated. Semiconductor zones of the same conductivity type are generally cross-hatched in the same direction; in the Figures, corresponding parts are generally designated by the same reference numerals.

DESCRIPTION OF THE PREFERRED EMBODIMENTS

Figure 2:
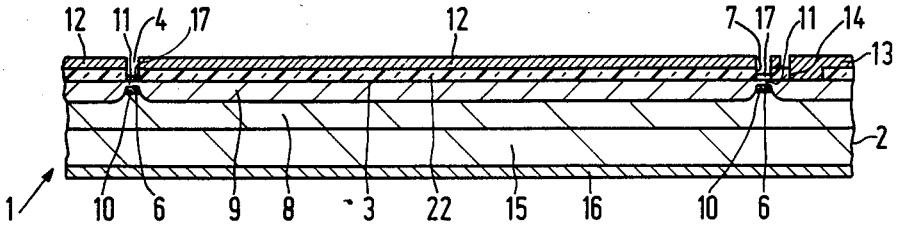
FIG. 2 shows a cross-section taken on the line II—II in FIG. 1.

The semiconductor device 1 of FIGS. 1 and 2 comprises a semiconductor body 2, for example of silicon, having at a major surface 3 a plurality of emission regions 4, which in this embodiment are arranged according to an annular pattern indicated in FIG. 1 by the dot-and-dash lines 5. The actual emission regions 4 are situated at the area of the openings 7 in an insulating layer 22 of, for example, silicon oxide.

The semiconductor device comprises a pn junction 6 between a p-type substrate 8 and an n-type zone 9, 11 consisting of a deep n-type zone 9 and a shallow zone 11. At the area of the emission regions 4, the pn junction is formed between an implanted p-type region 10 and the shallow zone, which in situ has such a thickness and doping that at the breakdown voltage of the pn junction 6 the depletion zone of the pn junction does not extend as far as the surface, but remains separated therefrom by a surface layer which is sufficiently thin to pass the electrons generated due to breakdown. Due to the highly doped p-type region 10, the pn junction has within the openings 7 a lower breakdown voltage so that the electron emission takes place substantially solely in the region 4 at the area of the openings 7. Furthermore, the arrangement is provided with an electrode 12. This electrode is subdivided in this embodiment into two subelectrodes $12^a$, $12^b$ so that the generated electrons can be deflected. The electrode 12 need not always be present, however. For contacting the n-type zone 9, a contact hole 14 is provided in the insulating layer 22 on behalf of a contact metallization 13, while on the lower side the substrate 8 can be connected via a highly doped p-type zone 15 and a contact metallization 16. Within the openings 7, a monolayer of caesium is applied to the surface 3 in order to reduce the work function of the electrons.

For a further description of the structure, the operation and the manufacturing method of semiconductor devices of the kind shown in FIGS. 1 and 2, reference may be made to the said Netherlands Patent Application No. 7905470. In an embodiment shown therein, an annular emission pattern is obtained by means of an annular opening in the oxide located on the surface, within which the breakdown of the pn junction is reduced with respect to other areas. Such an annular pattern is indicated in FIG. 1 by the dotand-dash lines 5. The annular strip defined for this purpose has a strip width of about 3 μm, while the ring has a diameter of about 200 μm.

According to the invention, the device does not comprise an annular emitting region, but it comprises a number (about 25) of separate emission regions 4, which are arranged in a ring having a diameter of about 200 μm. The separate emission regions 4 are preferably circular and have a diameter of about 2 μm. The overall emitting surface area is thus reduced from about 1800 $\mu m^2$ to about 80 $\mu m^2$.

With an unchanged overall emission current, the emission current density is now much larger. Such an increased emission current density contributes to a more rapid desorption of ions, atoms and molecules ($H_2O$, $CO_2$, $O_2$) adsorbed at the caesium layer 17. At the same time, due to the smaller dimensions of the emission regions 4, the current density through the n-type regions 6, 11 is higher. The higher electric fields associated therewith accelerate any diffusion of adsorbed ions from the emission region 4. The stability of the electron emission is therefore considerably increased.

Figure 3:
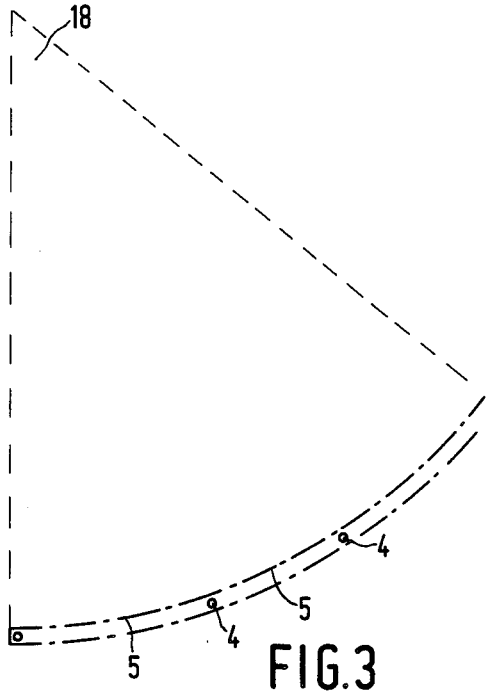
FIG. 3 shows on an enlarged scale the segment 18 of FIG. 1.

FIG. 3 is a plan view of the segment 18 of FIG. 1, only the emission region 4 and the region indicated by the dot-and-dash lines 5 being shown.

Figure 4:
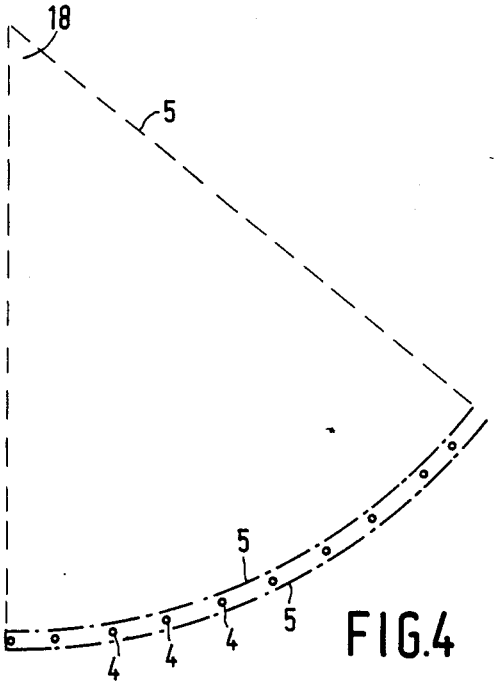
FIG. 4 shows another realization of such a segment.

FIG. 4 shows a similar segment 18, a cross-section of about 1 μm being chosen for the emission regions 4. With the same emission current, the number of emission regions increases in inverse proportion to the diameter of the emission regions. With an unchanged pattern 5 having a diameter of about 200 μm, a device with such small emission regions comprises about 50 emission regions 4.

In general, the gain in local current density is larger as the diameter of the emission regions 4 is smaller; this diamter preferably lies between 10 nm and 10 μm.

Figure 5:
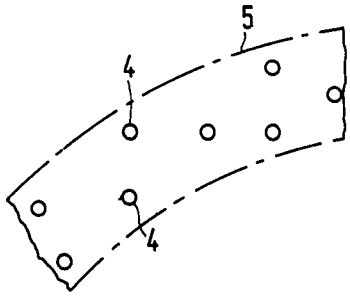
FIGS. 5, 6 and 7 show in plan view other semiconductor devices according to the invention.

The emission patterns may also be uniformly distributed over an annular pattern, as is shown in FIG. 5, in which a segment of such a pattern is represented with a width of the region 5 of about 5 μm and a diameter of the emission regions 4 of about 1 μm.

On the other hand, the stability of a semiconductor cathode can be increased by reducing in the same manner as described above for an annular pattern the overall emitting surface area by distributing a number of smaller emission regions uniformly over this surface.

Figure 6:
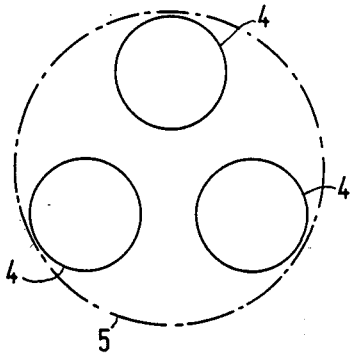
Figure 7:
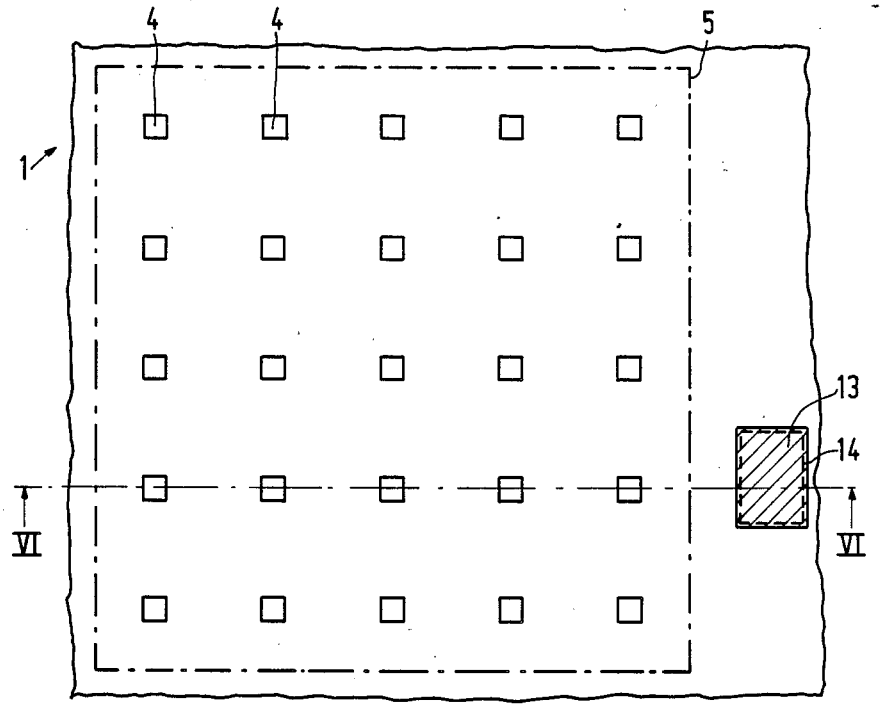
Figure 8:
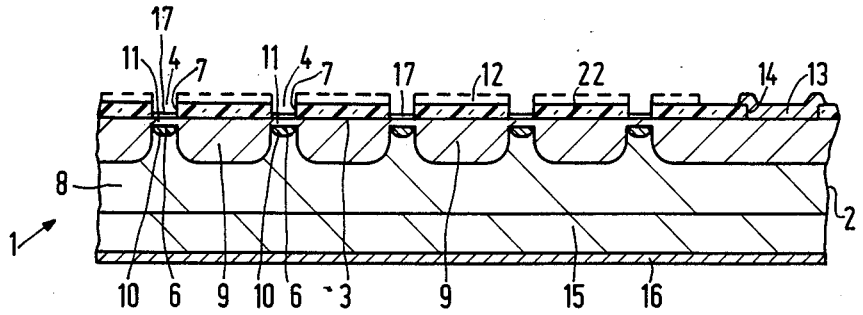
FIG. 8 shows a cross-section taken on the line VIII—VIII in FIG. 7.

FIG. 6 illustrates how, for example, a region 5 having an original diameter of about 1.5 μm can be subdivided into three emission regions 4 having a diameter of about 0.5 μm. Such a subdivision is particularly suitable for patterns having a diameter of the region 5 smaller than about 10 μm. For larger diameters (10–100 μm) an arrangement similar to that shown in FIG. 5 may often advantageously be used. An arrangement according to the invention, in which this measure is used in a square emission region indicated by the dot-and-dash line 5 is shown in Figures 7, 8. The reference numerals in this case have the same meaning as in FIGS. 1,2 while it is to be noted that the electrode 12 is shown only diagrammatically, which is once more an indication that this electrode need not necessarily be always present.

Instead of being arranged in circular form, the emission regions 4 may also be arranged according to linear patterns, for example on behalf of display applications or applications as described in Netherlands Patent Applications No. 8300631 and No. 8400632.

Figure 9:
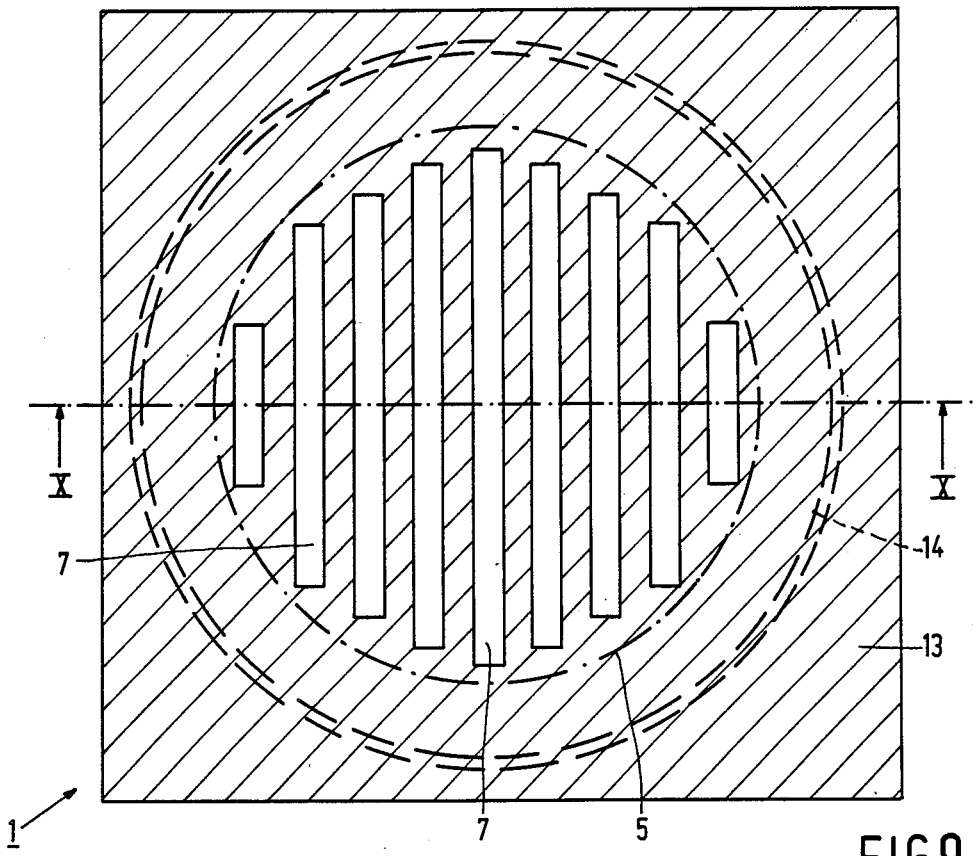
FIG. 9 is a plan view of a semiconductor device according to the invention having a high filling factor.
Figure 10:
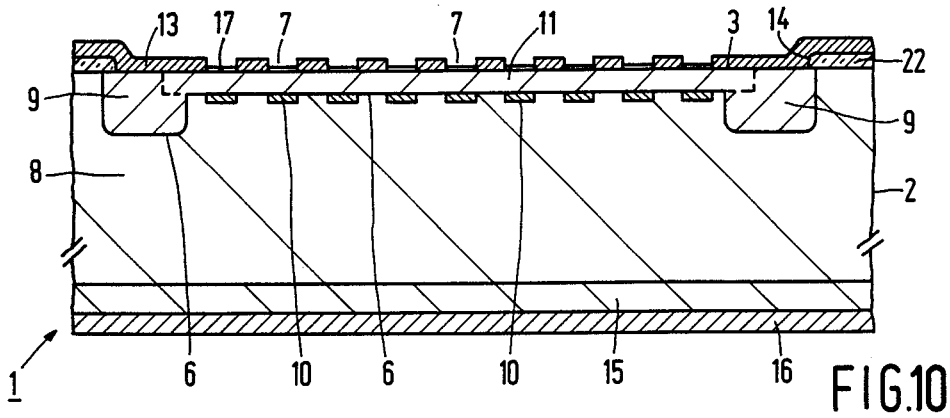
FIG. 10 is a cross-sectional view taken on the line X—X in FIG. 9.

The semiconductor device 1 shown in FIGS. 9 and 10 comprises a semiconductor body 2 of, for example, silicon having at a major surface 3 a plurality of emission regions, which in this embodiment are strip-shaped and are located within a circular pattern indicated in FIG. 9 by the dot-and-dash line 5. The emission regions are located at the area of openings 7 in the layer 13 of conducting material, such as, for example, tantalum.

The semiconductor device has a pn junction 6 between a p-type substrate 8 and an n-type zone 9, 11 consisting of a deep n-type zone 9 and a shallow zone 11. At the area of the emission regions, the pn junction is situated between an implanted p-type region 10 and the shallow zone, which in situ has such a thickness and doping that at the breakdown voltage of the pn junction 6 the depletion zone of the pn junction does not extend as far as the surface, but remains separated therefrom by a surface layer which is sufficiently thin to allow the electrons generated due to the breakdown to pass. Due to the highly doped p-type region 10, the pn junction has within the openings 7 a lower breakdown voltage so that the electron emission takes place practically solely in the regions at the area of the openings 7.

Within the openings 7, a monolayer 17 of a material reducing the work function, such as, for example, caesium, is applied to the surface 3.

In this embodiment, the n-type zone 9, 11 is contacted by means of the conducting layer 13 via a contact hole 14 in an insulating layer 22, which covers the surface 3 outside the n-type zone 9, 11. Due to the fact that now the current supply takes place mainly via the layer 13, the effective current density can be considerably increased. The potential differences in the layer 13 also remain small so that secondary effects due to high field strengths, such as, for example, caesium transport, do not occur.

At the lower side, the substrate 8 can be connected via a highly doped p-type zone 15 and a contact metallization 16.

The strip-shaped openings 7 in FIG. 9 have a width of about 1 μm and are located at a relative distance of about 1 μm. In the configuration shown in FIG. 9, a filling factor of about 50% can then be attained.

For the conducting layer 13, a material is preferably chosen which does not or substantially not diffuse into the silicon, such as, for example, tantalum.

The device shown in FIGS. 9 and 10 can be manufactured in a simple manner, for example, by first providing the n-type zones 9, 11 by ion implantation.

Subsequently, the metal pattern 13 is provided, for example by means of a lift-off technique. While using the metal pattern thus obtained as a mask, the p-type zones 10 are then provided at the area of the openings 7 by means of ion implantation, as a result of which the breakdown voltage of the pn junction 6 is decreased in situ. For a more detailed description of the structure and the operation of the semiconductor device shown in FIGS. 1 and 2, reference may be made to the said Netherlands Patent Application No. 7905470.

The openings 7 may be chosen to be circular instead of strip-shaped, in which event the emitting surfaces are distributed substantially homogeneously over the whole surface. The cathode stability is increased when the width of the openings 7 and hence the electron-emitting regions are redcued.

Figure 11:
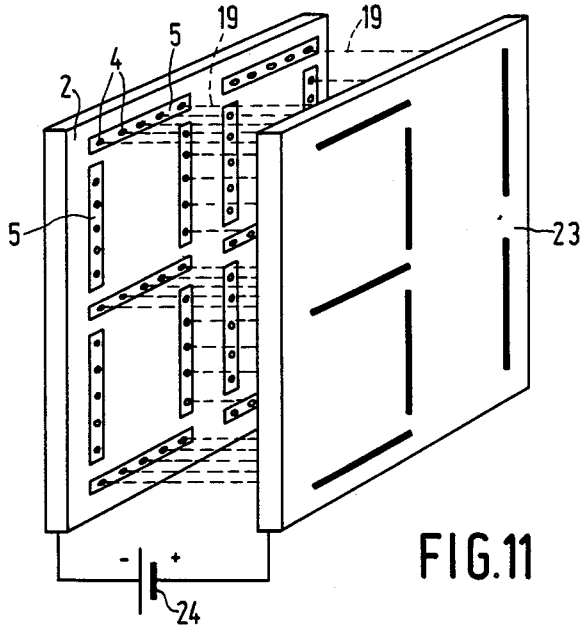

FIG. 11 shows diagrammatically in elevation a perspective view of a flat display arrangement which comprises besides the semiconductor body 2 a fluorescent screen 23 which is activated by the electron current 19 originating from the semiconductor body. The distance between the semiconductor body and the fluorescent screen is, for example, 5, while the space in which they are located is evacuated. A voltage of the order of 5 to 10 kV is applied between the semiconductor body 2 and the screen 23 via the voltage source 24, which leads to such a high field strength between the screen and the arrangement that the picture of a cathode is of the same order as this cathode.

The emission regions 4 are arranged on the surface of the semiconductor body according to linear patterns 5, which are activated by means of an auxiliary electronic system (not shown), which, if required, is also integrated in the semiconductor body 2.

One or more groups, which emit according to linear patterns, are each time driven in the same manner so that in the present embodiment, depending upon the drive, characters are displayed on the screen 23.

Figure 12:
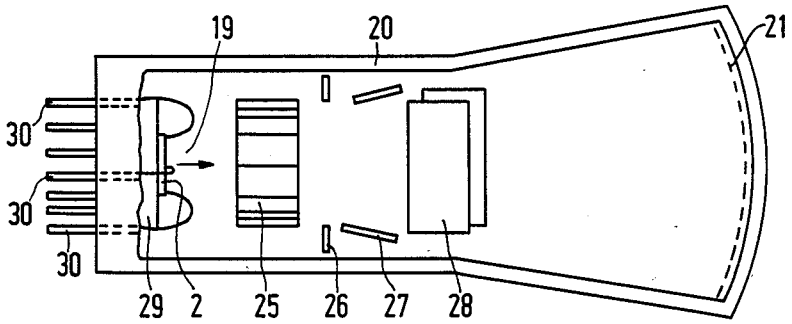
FIG. 12 shows a pick-up device which comprises a semiconductor device according to the invention.

FIG. 12 shows diagrammatically a cathode-ray tube, for example a camera tube, having a hermetically sealed vacuum tube 20, which tapers in the form of a funnel, the terminal wall being coated on the inner side with a fluorescent screen 21. The tube further comprises focusing electrodes 25, 26 and deflection electrodes 27, 28. The electron beam 19 is generated in one or more cathodes of the kind described above, which are located in a semiconductor body 2, which is mounted on a holder 29. Electrical connections of the semiconductor device are passed to the outside via lead-through members 30.

Of course the invention is not limited to the embodiments shown here, but several variations are possible within the scope of the invention for those skilled in the art.

For example, electrons may be generated in the emission regions according to principles quite different from avalanche multiplication. Mention may be made of the principle of a NEA cathode or of the principles on which the cathodes described in British Patent Applications No. 8133501 and No. 8133502 are based.

Additionally, the emission regions need not always be chosen to be circular or square, but they may have various other forms and may be, for example, rectangular or elliptical, which especially in the device shown in FIGS. 1, 2 is favorable from an electro-optical point of view.

Depending upon the possibilities of the semiconductor technology, the diameters of the emission regions will be chosen to be smaller than the value of 0.5 μm mentioned in the embodiment shown in FIG. 6. On the one hand, the region 5 may then be subdivided into a larger number of emission regions 4, whereas on the other hand with unchanged number a smaller diameter may be chosen for the region 5.

Figure 13:
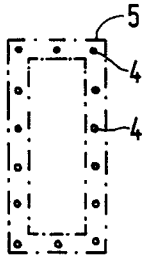
FIG. 13 is a plan view of still another semiconductor device according to the invention.

In the same manner as the round pattern of FIG. 6 may be advantageously replaced in certain cases by a circular pattern, the strip-shaped patterns of FIG. 7 may be replaced by rectangular patterns as shown in FIG. 13.

Further, in the arrangement of FIG. 8, the emitting regions 4 may be obtained by a uniform n-type layer 11, which adjoins a contact diffusion 9, a reduced breakdown voltage being locally obtained within the openings 7 by means of, for example, a boron implantation.

What is claimed is:

1. A semiconductor device for producing an electron current, which comprises:

a cathode having a semiconductor body with a major surface;

means for increasing the operational stability of said semiconductor device comprising an emission area having at least one group of separate, spaced-apart emission regions at said major surface arranged in a two-dimensional pattern, the area of each said emission region being at most equal to 100 $\mu m^2$; in combination with means for commonly adjusting the operating condition of said group of regions with respect to the emission of electrons, comprising two common electrical connections to at least two corresponding regions of said group.

2. A semiconductor device as claimed in claim 1, characterized in that the group of regions is distributed substantially homogeneously over a part of the major surface.

3. A semiconductor device as claimed in claim 1 or 2, characterized in that the group of regions is arranged in an annular pattern.

4. A semiconductor device as claimed in claim 1 or 2, characterized in that the semiconductor body comprises several groups of regions which are separately adjustable.

5. A semiconductor device as claimed in claim 1 or 2, characterized in that the regions each have a surface area of at most 5 $\mu m^2$.

6. A semiconductor device as claimed in claim 1 or 2, characterized in that the semiconductor body has a pn junction between an n-type region adjoining the major surface and a p-type region, in which, when a voltage is applied in the reverse direction across the pn junction, electrons are generated in the semiconductor body by avalanche multiplication, which emanate from the semiconductor body, the surface being provided with an electrically insulating layer, in which several openings are provided, the pn junction extending at least within the opening substantially parallel to the major surface and locally having a lower breakdown voltage than the remaining part of the pn junction, the part having a lower breakdown voltage being separated from the surface by an n-type conducting layer which has such a thickness and doping that at the breakdown voltage the depletion zone of the pn junction does not extend as far as the surface, but remains separated therefrom by a surface layer which is sufficiently thin to pass the generated electrons.

7. A semiconductor device as claimed in claim 6, characterized in that at least one electrode is provided on at least a part of the insulating layer.

8. A semiconductor device as claimed in claim 1 or 2, characterized in that the semiconductor body has a pn junction between an n-type region adjoining the major surface and a p-type region, while, when a voltage is applied in the reverse direction across the pn junction, electrons are generated in the semiconductor body by avalanche multiplication, which electrons emanate from the semiconductor body, the pn junction extending at least at the area of the electron-emitting regions mainly parallel to the major surface and locally having a lower breakdown voltage than the remaining part of the pn junction, the part having a lower breakdown voltage being separated from the surface of an n-type conducting layer having such a thickness and doping that at the breakdown voltage the depletion zone of the pn junction does not extend as far as the surface, but remains separated therefrom by a surface layer which is sufficiently thin to allow the generated electrons to pass, and in that the n-type region is coated with a layer of electrically conducting material, which contacts the n-type region and is provided with openings at the area of the electron-emitting regions.

9. A semiconductor device as claimed in claim 8, characterized in that the electron-emitting regions are substantially strip-shaped.

10. A semiconductor device as claimed in claim 8, characterized in that the electron-emitting regions are distributed over a substantially circular surface region.

11. A semiconductor device as claimed in claim 1 or 2, characterized in that the major surface is coated at the area of the electron-emitting regions with a layer of material reducing the electron work function.

12. A camera tube provided with means for controlling an electron beam which scans a charge image, characterized in that the electron beam is produced by a semiconductor device as claimed in claim 1 or 2.

13. A display arrangement provided with means for controlling an electron beams which produces an image, characterized in that the electron beam is produced by means of a semiconductor device as claimed in claim 1 or 2.

14. A display arrangement as claimed in claim 13, characterized in that it has a fluorescent screen which is located in vacuo at a distance of a few millimeters from the semiconductor device and the screen is activated by the electron beam originating from the semiconductor device.

* * * * *